US010738492B1

(12) United States Patent
McFarland

(10) Patent No.: US 10,738,492 B1
(45) Date of Patent: Aug. 11, 2020

(54) AQUATIC SPORTS AMUSEMENT APPARATUS

(71) Applicant: American Wave Machines, inc., Solana Beach, CA (US)

(72) Inventor: Bruce McFarland, Solana Beach, CA (US)

(73) Assignee: American Wave Machines, Inc., Solana Beach, CA (US)

( * ) Notice: Subject to any disclaimer, the term of this patent is extended or adjusted under 35 U.S.C. 154(b) by 0 days.

(21) Appl. No.: 16/671,486

(22) Filed: Nov. 1, 2019

Related U.S. Application Data

(60) Provisional application No. 62/812,989, filed on Mar. 2, 2019.

(51) Int. Cl.
*E04H 4/00* (2006.01)

(52) U.S. Cl.
CPC ..... *E04H 4/0006* (2013.01)

(58) Field of Classification Search
CPC ..... E04H 4/143
USPC ..... 4/491; 405/79–80; 700/275, 281–282; 715/799, 769
See application file for complete search history.

(56) References Cited

U.S. PATENT DOCUMENTS 4,515,500 A 5/1985 Bastenhoff
4,558,474 A * 12/1985 Bastenhof ..... E04H 4/0006 4/491
4,730,355 A * 3/1988 Kreinbihl ..... E04H 4/0006 137/872
4,979,244 A * 12/1990 Bastenhof ..... E04H 4/0006 137/875
9,103,133 B2 * 8/2015 McFarland ..... E04H 4/0006
2008/0085159 A1 4/2008 McFarland
2008/0141921 A1 * 6/2008 Hinderks ..... B63B 1/28 114/274
2010/0158611 A1 6/2010 DeMarteau
2012/0227389 A1 * 9/2012 Hinderks ..... F01L 13/0042 60/317
2017/0314701 A1 11/2017 Vulkan

FOREIGN PATENT DOCUMENTS

EP 0287714 10/1988
JP 5-231395 10/2001

OTHER PUBLICATIONS

International Search Report/Written Opinion dated Apr. 21, 2020 for PCT/US20/13747.

* cited by examiner

*Primary Examiner* — Lori L Baker
(74) *Attorney, Agent, or Firm* — Manuel de la Cerra

(57) ABSTRACT

An aquatic sports amusement apparatus includes a plurality of wave generating chambers that release water into a pool. A plenum is pneumatically connected to each chamber and a plurality of fans is connected to the plenum to pressurize the plenum. A plurality of sensors is also connected to the plenum and measure the pressure of the plenum. And a plurality of vents is connected to the plenum and release pressure from the plenum upon actuation. A controller connected to the vents and sensors, performs the following steps: (a) measure the pressure from a sensor in the plurality of sensors; and (b) if the measured pressure is greater than a preset set point pressure, then actuating a vent from the plurality of vents to release pressure.

20 Claims, 7 Drawing Sheets

AQUATIC SPORTS AMUSEMENT APPARATUS

RELATED APPLICATIONS

This application claim priority as the non-provisional of U.S. Ser. No. 62/812,989 filed on Mar. 2, 2019, the entire contents of which are incorporated herein by reference.

This application is also related to U.S. Ser. No. 16/149,051 filed on Oct. 1, 2018, which is a continuation of U.S. Ser. No. 14/808,076 filed on Jan. 27, 2016, which is a divisional of U.S. Ser. No. 13/740,419 filed on Jan. 14, 2013, which is the non-provisional of U.S. Ser. No. 61/721,304 filed on Nov. 1, 2012, all of which are by the same inventor, and all of which are incorporated herein by reference in their totality.

TECHNICAL FIELD

The present application relates to wave generators, such as, for example, wave generators for making waves in pools for recreational purposes.

BACKGROUND

Previous disclosures by the present inventor have included an aquatic sports amusement apparatus that includes a pool, a plurality of wave generating chambers that release water into a pool, and a mobile application controller that operates the chambers, such that each chamber in the plurality releases water to create waves. The controller can be connected to the plurality of chambers via a network connection; such a connection could include a local area network, a wireless network, the internet and/or a virtual private network. The controller could be located at a distant location from the pool and chamber complex, and the controller may be a smart phone, a personal computer, a personal digital assistant, a laptop and/or a tablet computer. Those disclosures can be found in applications listed above.

The release of the water from the chambers may be performed by manipulating the air pressure in the chambers, as disclosed in detail in the patent applications listed above. During implementation, however, the ability to create a stable amount of useable pressure is difficult, with the fans that create the needed air pressure often operating in the unstable region. Unfortunately, this region is plagued by several drawbacks: (1) accurate control of air pressure is difficult, if not impossible, (2) the fans are inefficiently drawing power without contributing to the needed pressure, and (3) the fans may prematurely wear.

What is needed therefore is a system that overcomes these drawbacks.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

What is provided herein is an aquatic sports amusement apparatus to control fan instability. The apparatus includes a plurality of wave generating chambers that release water into a pool. A plenum is pneumatically connected to each chamber, and a plurality of fans is connected to the plenum and pressurizes the plenum. A plurality of sensors is also connected to the plenum and measures the pressure of the plenum, and a plurality of vents is connected to the plenum and can release pressure from the plenum upon actuation. A controller connected to the vents and sensors performs the following steps: (a) measure the pressure from a sensor in the plurality of sensors; and (b) if the measured pressure is greater than a preset set point pressure, then actuating a vent from the plurality of vents to release pressure.

The number of fans need not be not equal to the number of sensors or the number of vents. The vent may be a vent valve or an inlet fan damper.

The actuation of the vent by the controller may be for a preset time period, or until a second preset set point is reached. The controller step (b) may be delayed until the controller confirms that the preset set point has been reached, which may be helpful during the startup of the apparatus.

Additional aspects, alternatives and variations, as would be apparent to persons of skill in the art, are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views. It may be understood that certain components and details may not appear in the figures to assist in more clearly describing the invention.

DETAILED DESCRIPTION

Figure 1:
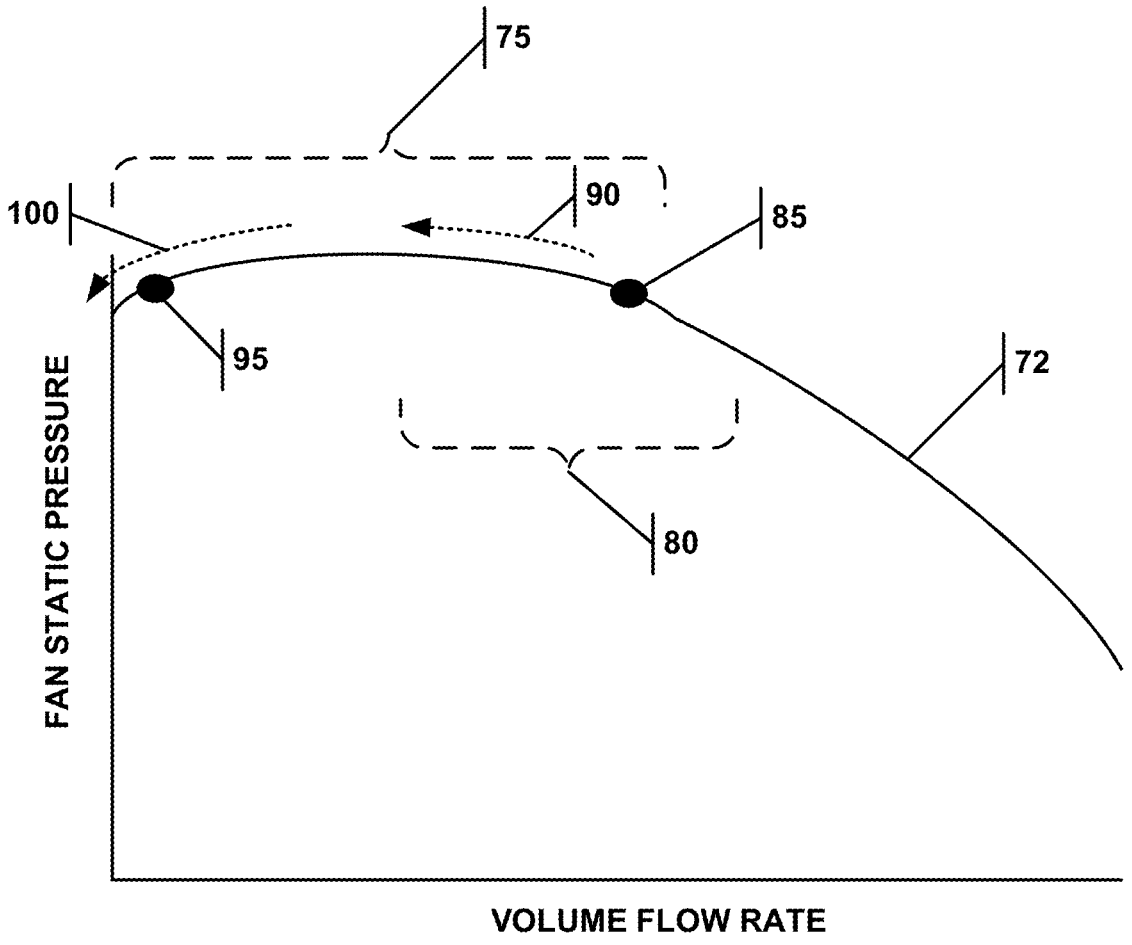
FIG. 1 is a pressure v. flowrate curve showing the fan instability region.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with attached figures and is provided for ease of reference, where like reference numerals designate corresponding features throughout the specification and figures:

Fan 10
Plenum 15
Chamber 20
Pool 25
Exhaust Valve 30
Vent Valve 35
Pressure Sensor 37
Inlet Valve 40
Fan Outlet Nozzle 45
Fan Outlet Damper 50
Fan Inlet Damper 55
Fan Inlet Filter 60
Fan Inlet Isolator 65
Fan Inlet Flow Conditioner 70
Fan Pressure/Flowrate Curve 72
Fan Instability Region 75
Fan Optimal Performance Region 80
Fan Curve Position in Optimal Range 85
Movement of Fan Along Curve to Non-Optimal Region 90
Fan Curve Position in Non-Optimal Range 95
Movement of Fan Along Curve to Negative Flow Rate 100
Pressure Set Point 105
Movement of Fan Along Curve to Pressure Set Point 106
Return Movement of Fan Along Curve to Optimal Stable Range After Venting Trigger By Pressure Set Point 107
Fan Energy Consumption 108
Controller 110
Set Point Implementation Method 200
Steps in Set Point Implementation Method 205-230
Startup Method 300
Steps in Startup Method 305-320

Figure 3:
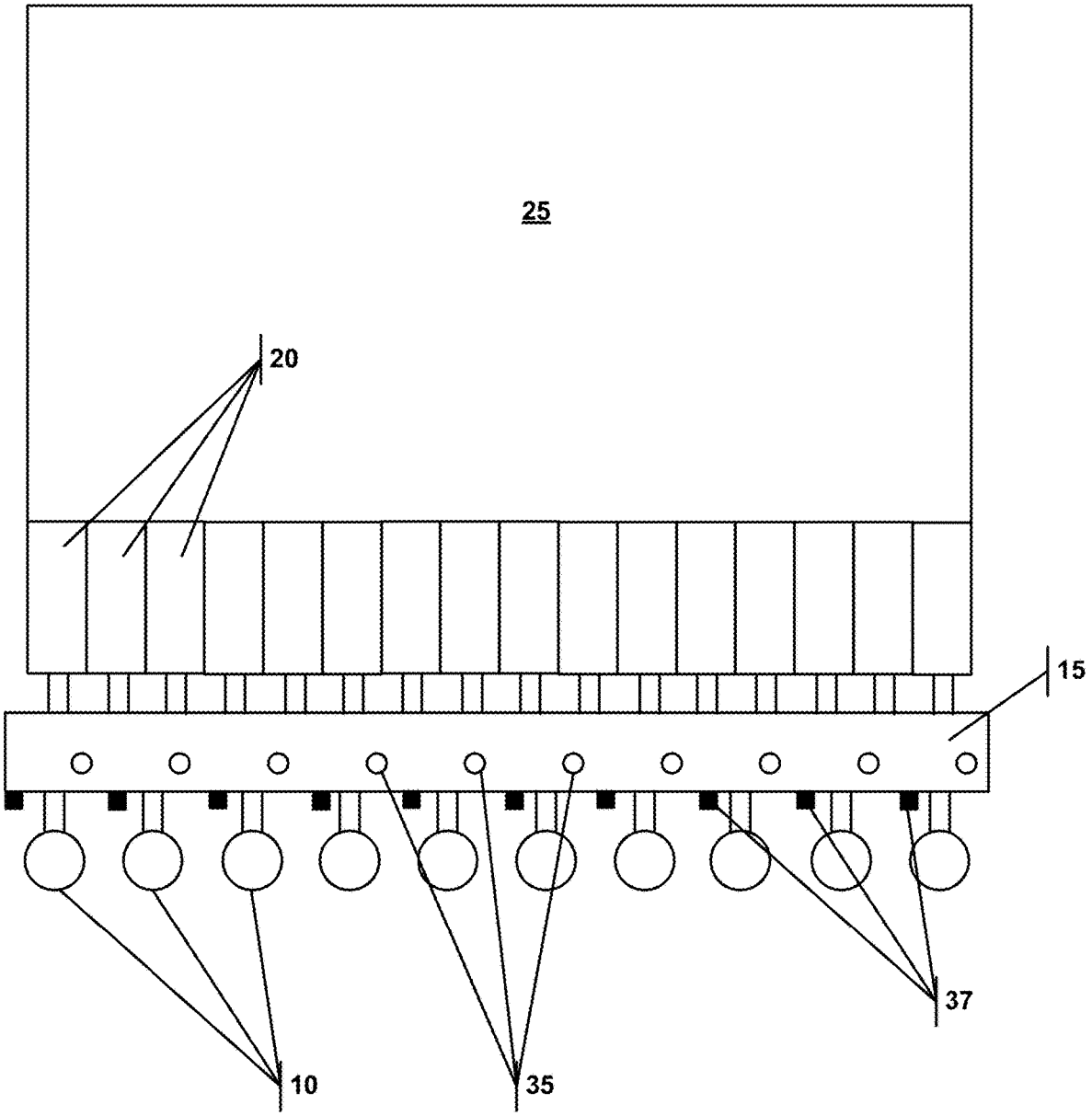
FIG. 3 is a top view of an aquatic sports amusement apparatus with a plurality of chambers with the improvements disclosed here.

To create the air pressure needed to actuate the wave making chambers described in the patent applications listed above, several fans should be used. Such an aquatic sports amusement apparatus is shown in FIG. 3, with ten fans 10 jetting air into a plenum 15, and that pressurized air is made available to the wave making chamber 20, which can then release water into the pool 25. The plenum 15 may be a single volume that is maintained a near constant pressure. The benefit of a single plenum 15 is that it will substantially equalize from the plurality of fans 10 the pressure, making control of the apparatus more reliable and robust. Also, should one fan fail or decrease in performance, the apparatus can continue operation by relying upon the pressure created by the other fans. While a single plenum 15 is shown in FIG. 3, it would be apparent that more plenums may be used. For example, two to five fans 10 may share a single plenum 15.

While the use of a plenum has the benefits cited above, it also has several drawbacks. The source of the problems is that a multi-fan system can cause single fans within the system to become unstable. Such instability has several drawbacks: (1) accurate control of air pressure is difficult, if not impossible; (2) the fans are inefficiently drawing power without contributing to the needed pressure; and (3) the fans may prematurely wear.

FIG. 1 illustrates a pressure v. flowrate curve 71 showing a fan's instability region 75. A fan can operate at various positions along this curve 71. It should be noted that different fans have different pressure v. flowrate curves. A fan's optimal region is shown by bracket 80. In the unstable region, the fan has two possible operating positions for the same pressure—but those positions have significantly different flowrates. So if a fan is operating at position 85, it is possible that the fan will move along the curve to a non-optimal region, shown by arrow 90. If the fan continues along the curve 72 past the origin (shown by arrow 100) the fan can actually have a negative flow rate—i.e., the fan is turning but air is flowing in the wrong direction. Operating in the negative flow region can cause premature wear on the fan, and consumes power without any benefit from the fan.

When a plenum is used, it is possible for one or more fans connected to the plenum to move into the unstable region to the left of the curve hump. When this happens it becomes difficult, if not impossible to maintain the needed air pressure in the plenum for the proper operation of the chambers. Further, the operator would not know which of the fans has become unstable.

To overcome this problem, the present disclosure presets a pressure set point and a pressure relief structure to maintain the pressure below that set point. This is shown graphically in FIG. 2, which shows the same pressure v. flowrate curve 71 of FIG. 1. If a fan begins at position 109, then moves along the curve to the pressure set point 100, as shown by arrow 106, the system vents the pressure so that the fan travels along the curve in the direction of arrow 107—i.e., returning to the optimal fan operation region.

Returning to FIG. 3, the various structures needed to implement the pressure set point will now be discussed. The apparatus includes a plurality of wave generating chambers 20 that releases water into a pool 25. A plenum 15 is pneumatically connected to each chamber 20, and a plurality of fans 10 is connected to and pressurizes the plenum 15. A plurality of sensors 37 is also connected to and measures the pressure of the plenum 15. A plurality of vents 35 is connected to and releases pressure from the plenum 15 upon actuation. While FIG. 3 shows the same number of vent valves 35 and pressure sensors 37 as fans 10, it will be apparent that there need not be a one-to-one match.

But the pressure within the plenum is not uniform in all portions of the plenum; indeed, fluctuation of greater than 5 inches of water have been measured within an operational plenum. Therefore, fans 10 connected to particular portions of the plenum 15 may be more susceptible to going unstable. Using multiple pressure sensors 37 and vents 35, wherein each sensor 37 and vent 40 is located near each fan 10, is a way to account for the variations in the plenum 15 and to more effectively abate fan instability.

Figures 4A, 4B:
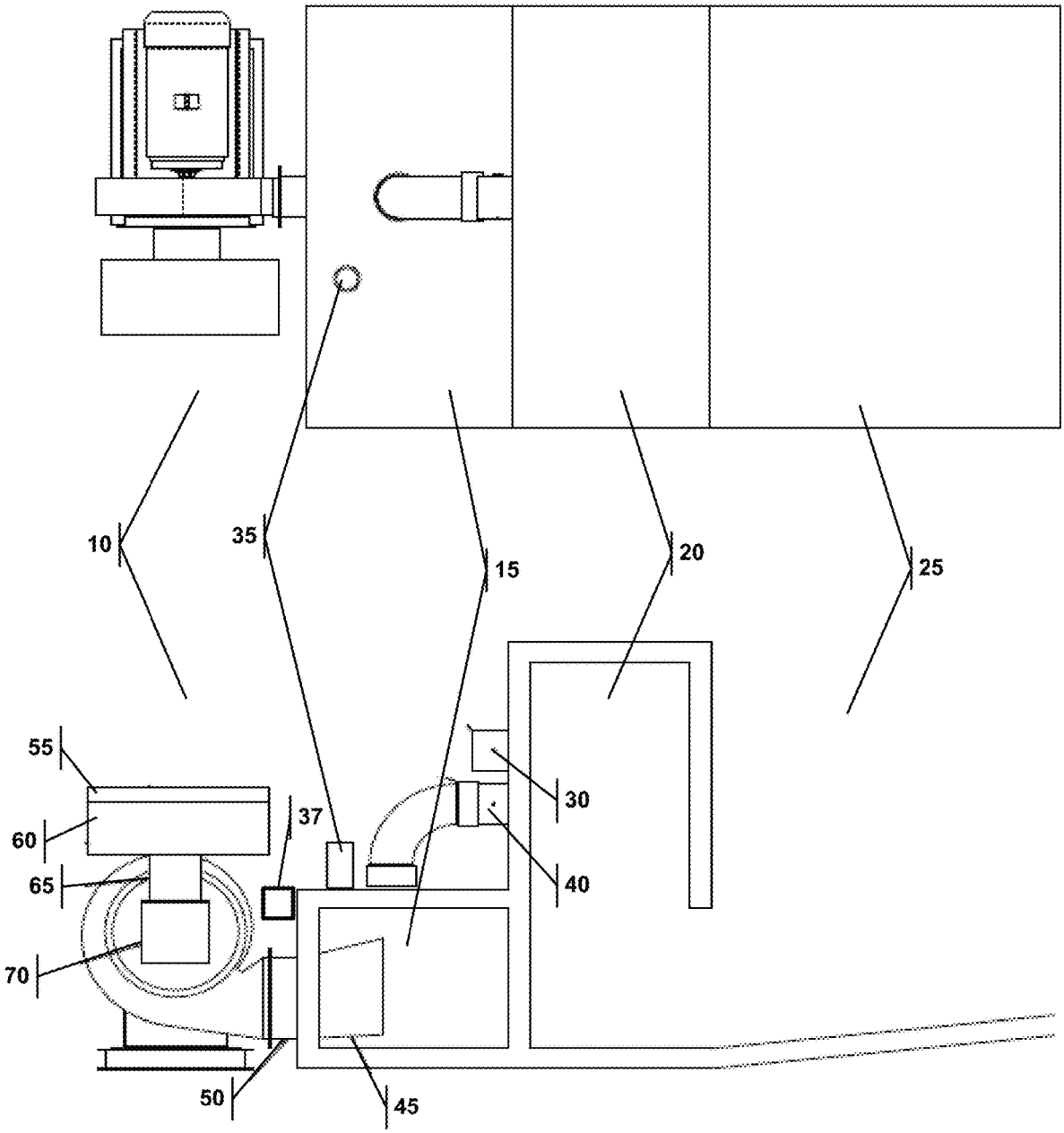
FIG. 4A is a top view of a single fan connected to a single chamber.
FIG. 4B is a side cross-section view of FIG. 4A.

FIG. 4A is a top view of a single fan 10 connected to a single chamber 20 that releases water into the pool 25. A vent valve 35 may vent air pressure to atmosphere. FIG. 4B is a side cross-section view of FIG. 4A, showing the pressure sensor 37. This view also shows additional structures, including an exhaust valve 30, inlet valve 40, fan outlet nozzle 45, fan outlet damper 50, fan inlet damper 55, fan inlet filter 60, fan inlet isolator 65, and fan inlet flow conditioner 70. Importantly and as discussed in more detail below, the system may use the fan inlet damper 55 as a structure to vent the system.

Figure 5:
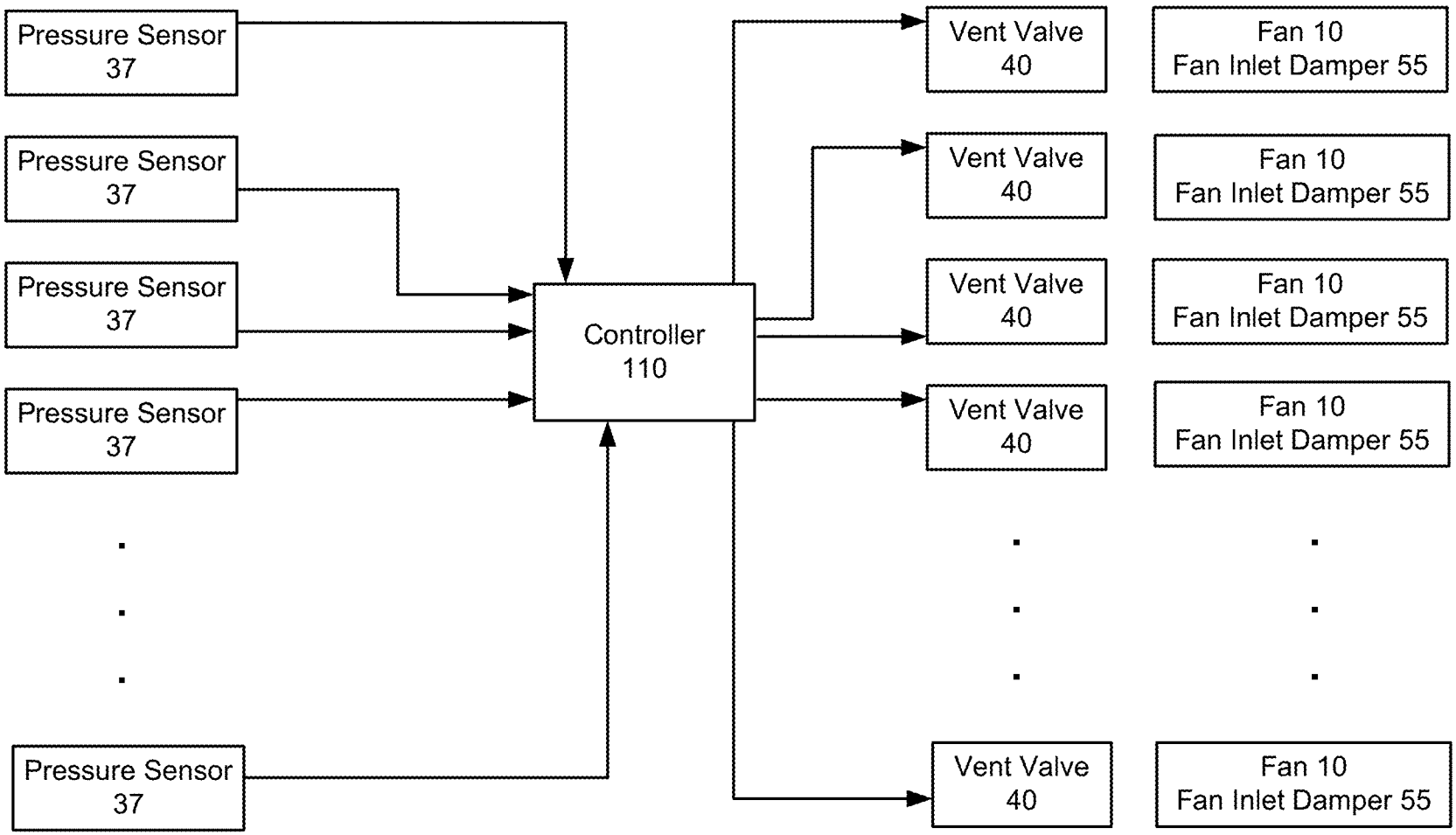
FIG. 5 is a schematic block diagram of a control system for detecting the pressure in the plenum and controlling operation of the vent valve, or alternatively the fan/fan inlet dampers, according to the pressure set point.

FIG. 5 is a schematic block diagram of a control system for detecting the pressure in the plenum 15 and controlling the operation of the vent valves 35, or alternatively that of the fan inlet dampers 55, according to the pressure set point 105. Specifically, the pressure sensors 37 are connected to a controller 110, which is also connected to the vent valves 40. The controller 110 may be a central processor with the appropriate algorithms to detect the set point pressure and to open the valves accordingly.

In preexisting systems, it may not be practical to modify the plenum 15 with vent valves 37. It may instead be more practical to control the operation of the fan 10 and its attendant inlet damper 55. For example, the inlet damper 55 may be comprised of variable vanes, which may be adjusted to actually allow air to flow in reverse through the fan—thus venting the plenum 15.

Determining the set point pressure will be a function of the unique characteristics of the wave making apparatus. Many variables may affect the proper selection of the set point pressure including, but not limited to: the number of fans, the type of fans, and the fluid dynamic flow of the air within the plenum from the fans to the chambers. Therefore, the set point pressure may be set by trial and error for a particular apparatus.

Figure 6:
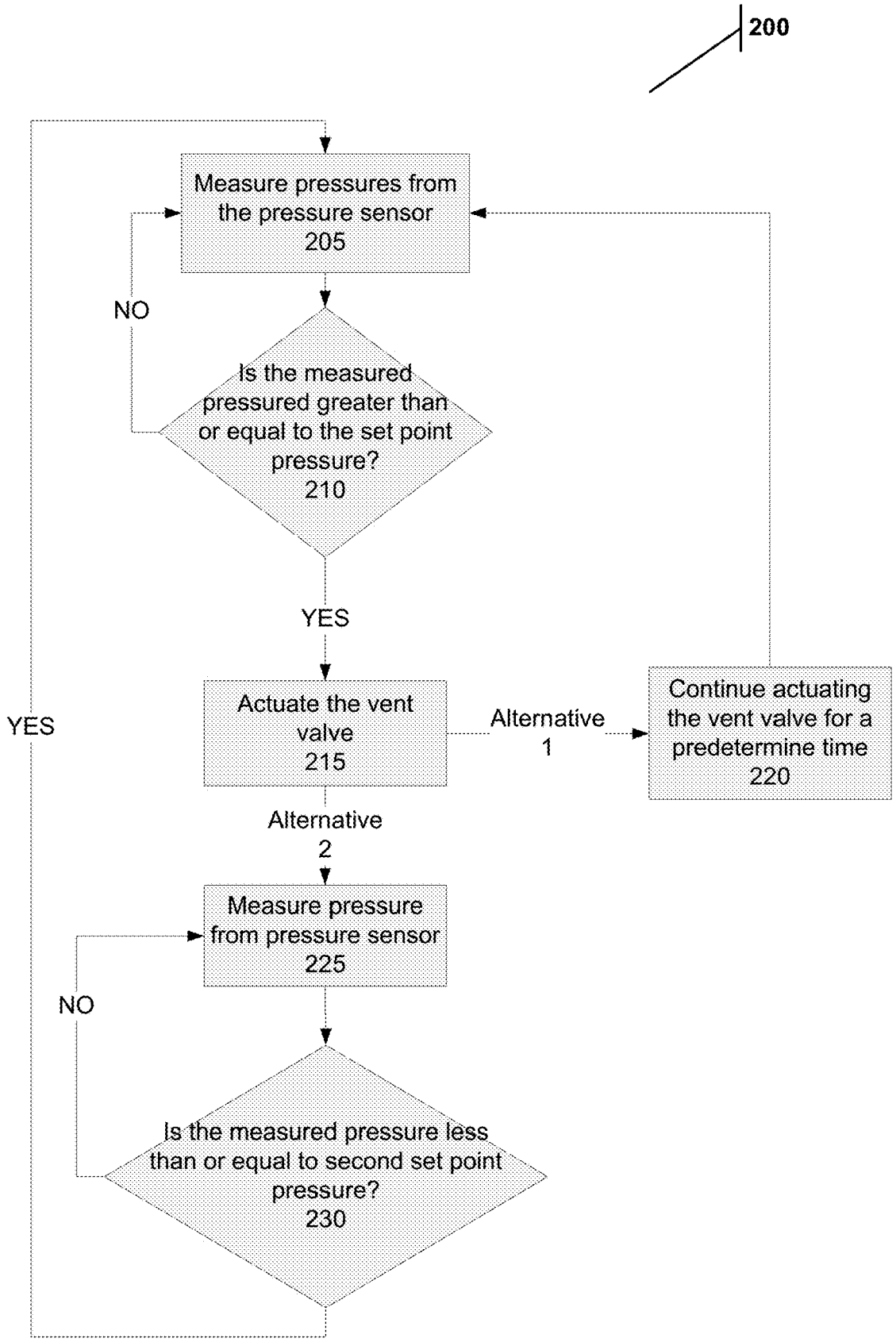
FIG. 6 is a flowchart showing the set point implementation method.

The set point implementation method 200 is shown in FIG. 6. For each pressure sensor 37, the controller 110 measures the pressure in step 205. If the measured pressure is greater than or equal to the set point pressure (step 210), then the controller 110 actuates the vent valve 35 in step 215. At this point, the system may continue venting for a predetermined time (step 220), such that the pressure will drop back into the optimal and stable region of the curve. Alternatively, the system may continue measuring the pressure (step 225) until the measure pressure is less than or equal to a second set point pressure—e.g. the set point pressure minus a margin pressure (step 230). The second set point pressure may be set based on the particulars of the system, such that the pressure returns to the optimal and stable region of the curve. Moreover, the second set point pressure (or the predetermined time period) should be set such that the system is pushed far enough away from the set point pressure to avoid a constant set point triggering. In other words, if the second set point pressure (or the predetermined time period) is not appropriately set, the system may trigger the set point too frequently.

Also, the system may not implement the set point pressure until the system is started up and operational. This avoids the set point pressure from triggering on the left side of the curve hump—see FIGS. 1 and 2. By delaying the implementation of the set point pressure until the system is warmed up—i.e., operating with reasonable certainty in the region to the right of the curve hump—the set point pressure venting will move the operation of the fan along the curve to the right.

Figure 2:
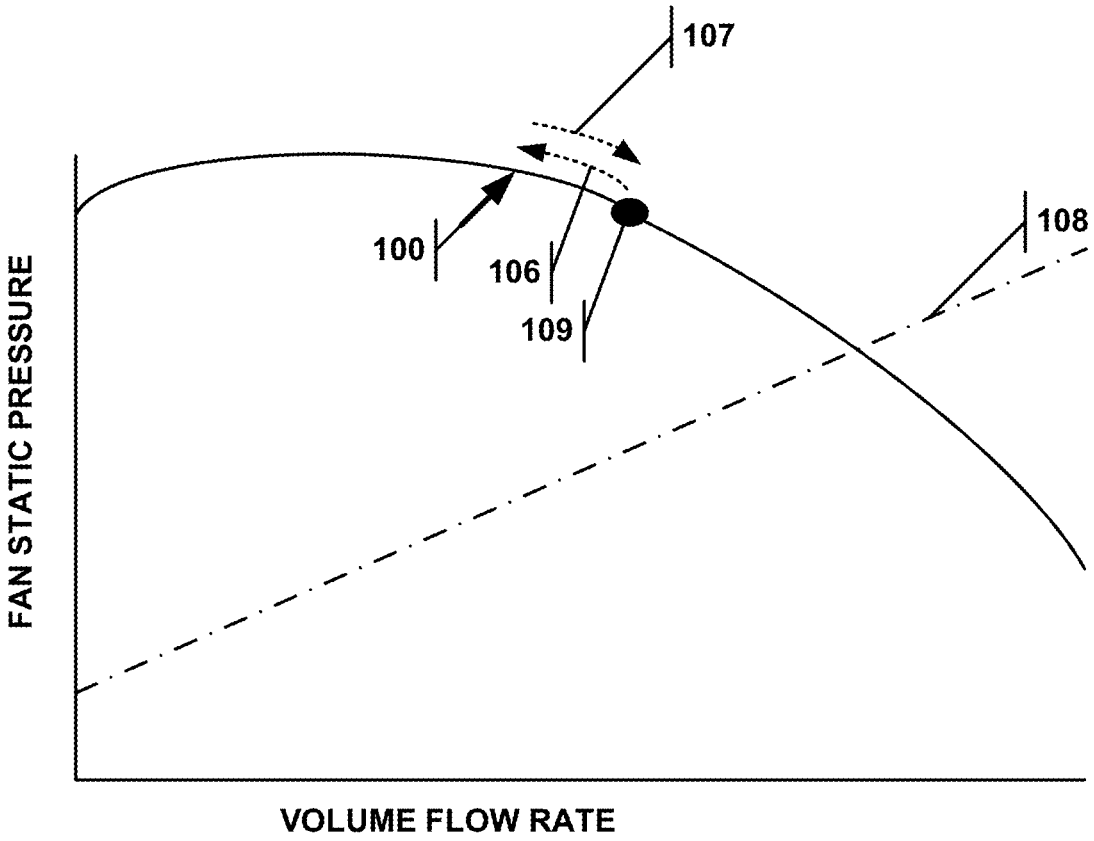
FIG. 2 is a pressure v. flowrate curve with a pressure set point that maintains the fan in the optimal region.
Figure 7:
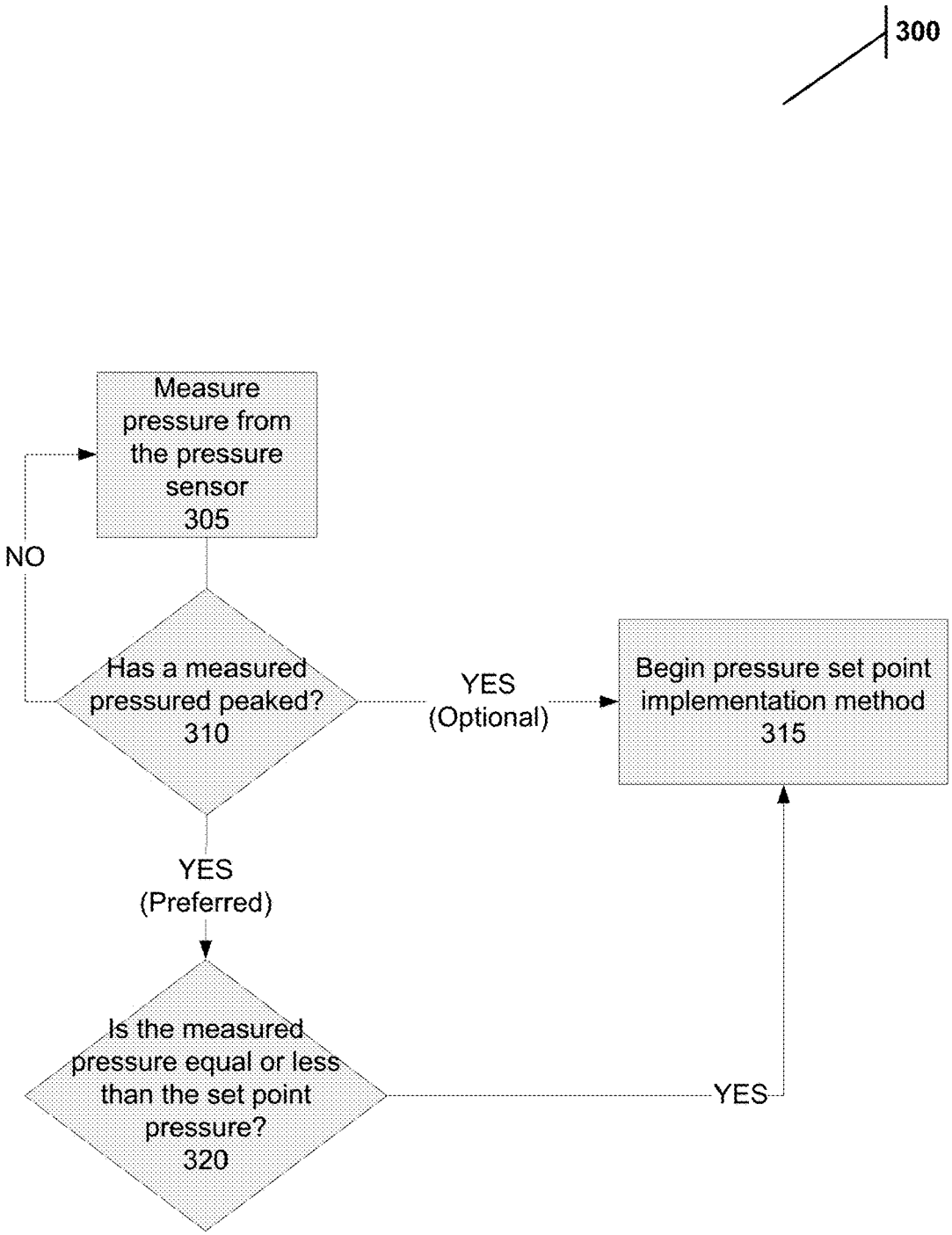
FIG. 7 is a flowchart showing the startup method.

The system may also record the historical pressures within the plenum upon startup, and those pressures should increase to a maximum and then decrease as the fans travel along the curve—see FIGS. 1 and 2. Based on the measured historical values, the system begins the pressure set point venting after the measured pressure has passed the peak of the curve hump, or, more preferably, when the measured pressure reaches the set point pressure to the right of the curve hump. A startup method 300 is shown in FIG. 7. For each pressure sensor 37, the controller 110 measures the pressure in step 305. If the measured pressure has peaked (step 310), then the system may begin the set point implementation method at step 315. Implementing the pressure set point method immediately after the hump, however, may be sub-optimal. It is possible that the system retreats to the left of the curve hump. Instead, it may be preferred to continue measuring the pressure after the pressure has peaked and has reached the set point pressure (i.e., to the right of the curve hump) as shown in step 320.

The system may also associate a particular pressure sensor 37 with a particular vent valve 40. As described above, the variation in pressure can be significant across the plenum 15; therefore, exceeding the set point pressure may be a localized issue within the plenum 15. To optimize the system, associating or pairing a sensor or group of sensors 37 with a vent valve or group of vent valves 40 could target venting the plenum 15 in the localized area. And because the vent valve 40 is optimally located near the fan 10, such venting will ensure that the fans experience the appropriate pressure and stay in the optimal region of the pressure v. flowrate curve. The controller 110, therefore, may perform the set point implementation method 200 on a pressure sensor/vent valve associated complex, such that the when the pressure of a sensor 37 exceeds the set point pressure (step 210), the controller in step 215 actuates the particular vent valve 40 associated with the sensor 37 that is reporting the exceeded pressure. Likewise, the step 225 and 230 may be done using the sensor/vent valve associated complex. Similarly, the startup method 300 may begin implementing the set point implementation method 200 in a sensor-by-sensor manner—which again reflects the reality that the plenum 15 is not at a uniform pressure throughout.

The above description of the disclosed example embodiments is provided to enable any person skilled in the art to make or use the invention. Various modifications to these example embodiments will be readily apparent to those skilled in the art, and the generic principles described herein can be applied to other example embodiments without departing from the spirit or scope of the invention. Thus, it is to be understood that the description and drawings presented herein represent a presently preferred example embodiment of the invention and are therefore representative of the subject matter which is broadly contemplated by the present invention. It is further understood that the scope of the present invention fully encompasses other example embodiments that may become obvious to those skilled in the art and that the scope of the present invention is accordingly limited by nothing other than the appended claims.

The invention claimed is:

1. An aquatic sports amusement apparatus, comprising:
a plurality of wave generating chambers that releases water into a pool;
a plenum pneumatically connected to each chamber;
a plurality of fans connected to the plenum and adapted to pressurize the plenum;
a plurality of sensors connected to the plenum and adapted to measure the pressure of the plenum;
a plurality of vents connected to the plenum and adapted to release pressure from the plenum upon actuation;
a controller connected to the vents and sensors, wherein the controller is constructed to perform the following steps:
a. measure the pressure from a sensor in the plurality of sensors;
b. when the measured pressure is greater than a preset set point, then actuate a vent from the plurality of vents to release pressure.

2. The apparatus of claim 1, wherein the actuation of the vent by the controller is for a preset time period.

3. The apparatus of claim 1, wherein the controller further performs the following step after step (b): measure the pressure from the sensor and continue actuation of the vent until the measured pressure is less than a second preset set point.

4. The apparatus of claim 1, wherein the vent is a vent valve.

5. The apparatus of claim 1, wherein the vent is an inlet fan damper.

6. The apparatus of claim 1, wherein the number of fans is not equal to the number of sensors.

7. The apparatus of claim 1, wherein the number of fans is not equal to the number of vents.

8. The apparatus of claim 1, wherein the controller further performs the following step before step (b): if the measured pressure has peaked then continue to step (b).

9. An aquatic sports amusement apparatus, comprising:
a plurality of wave generating chambers that releases water into a pool;
a plenum pneumatically connected to each chamber;
a plurality of fans connected to the plenum and adapted to pressurize the plenum;
a plurality of sensors connected to the plenum and adapted to measure the pressure of the plenum, wherein each of the plurality of sensors is located adjacent to each of the plurality of fans;
a plurality of vents connected to the plenum and adapted to release pressure from the plenum upon actuation, wherein each of the plurality of vents is located adjacent to each of the plurality of fans, and wherein each of the plurality of sensors is associated with each of the plurality of vents;
a controller connected to the plurality of vents and sensors, wherein the controller performs the following steps:
a. measure the pressure from each of the plurality of sensors;
b. for each sensor in the plurality of sensors where the measured pressure is greater than a preset set point, actuate the vent in the plurality of vents associated with the sensor to release pressure.

10. The apparatus of claim 9, wherein the actuation of the vent by the controller is for a preset time period.

11. The apparatus of claim 9, wherein the controller further performs the following step after step (b): measure the pressure from the sensor and continue actuation of the vent until the measured pressure is less than a second preset set point.

12. The apparatus of claim 9, wherein the plurality of vents are comprised of vent valves.

13. The apparatus of claim 9, wherein the plurality of vents are comprised of inlet fan dampers.

14. The apparatus of claim 9, wherein the number of fans is not equal to the number of sensors.

15. The apparatus of claim 9, wherein the number of fans is not equal to the number of vents.

16. The apparatus of claim 9, wherein the controller further performs the following step before step (b): if the measured pressure has peaked then continue to step (b).

17. A method for controlling fan instability in an aquatic sports amusement apparatus, the sports apparatus having a plurality of pneumatically controlled chambers that release water into a pool, the chambers are connected to a plenum that is pressurized by a plurality of fans, the method comprising:
a. measuring the pressure in the plenum;
b. releasing pressure from the plenum when the measured pressure reaches a preset set point.

18. The method of claim 17, wherein the release of pressure in step (b) continues for a preset time period.

19. The method of claim 17, wherein the release of pressure in step (b) continues until the measured pressure is less than a second preset set point.

20. The method of claim 17, wherein the release of pressure in step (b) is performed by actuating a vent valve.

* * * * *